US005593057A

United States Patent [19]

Kunzmann et al.

[11] Patent Number: 5,593,057

[45] Date of Patent: Jan. 14, 1997

[54] IDENTIFICATION MARKS OF PICTURE TUBE PARTS

[75] Inventors: Martin Kunzmann, Wernau; Erwin Rommel, Denkendorf, both of Germany

[73] Assignee: Nokia Technology GmbH, Pforzheim, Germany

[21] Appl. No.: 579,886

[22] Filed: Dec. 28, 1995

Related U.S. Application Data

[63] Continuation of Ser. No. 302,523, Sep. 8, 1994, abandoned.

[30] Foreign Application Priority Data

Sep. 10, 1993 [DE] Germany ..... 43 30 654.3

[51] Int. Cl.[6] ..... H01J 31/00

[52] U.S. Cl. ..... 220/2.3 A; 220/2.1 A; 313/477 R; 313/408

[58] Field of Search ..... 220/2.3 A, 2.1 A; 313/477 R, 408, 479, 513, 480

[56] References Cited

U.S. PATENT DOCUMENTS

| | | | |
|---|---|---|---|
| 4,327,283 | 4/1982 | Heyman et al. . | |
| 4,374,451 | 2/1983 | Miller . | |
| 4,515,867 | 5/1985 | Bleacher et al. | 428/204 |
| 4,600,360 | 7/1986 | Quarterman . | |
| 4,600,630 | 7/1986 | Quinn et al. . | |
| 4,638,213 | 1/1987 | Deal et al. | 313/479 |
| 5,019,004 | 5/1991 | Steiner et al. . | |
| 5,214,350 | 5/1993 | Remec et al. | 313/477 |

FOREIGN PATENT DOCUMENTS

| | | |
|---|---|---|
| 0395821 | 11/1990 | European Pat. Off. . |
| 2517116 | 5/1983 | France . |
| 3019402 | 11/1980 | Germany . |
| 3035996 | 4/1981 | Germany . |
| 3035997 | 4/1981 | Germany . |
| 3825846 | 2/1990 | Germany . |
| 4126626 | 2/1992 | Germany . |
| 1154430 | 6/1988 | Japan . |
| 63-187529 | 8/1988 | Japan . |
| 2058622 | 4/1981 | United Kingdom . |

OTHER PUBLICATIONS

"Werkstoffkunde der Hochvakuumtechnik", W. Espe, *Veb Deutscher Verlag der Wissenschaften,* Berlin 1962, Band II, pp. 361–365.

Patent Abstracts of Japan E–821, Sep. 14, 1989, vol. 13/No. 416, and JP 1–154330, pub Jun. 16, 1989.

Patent Abstracts of Japan E–690, Dec. 7, 1988, vol. 12, No. 465, and JP 63–187529, pub. Aug. 3, 1988.

Patent Abstracts of Japan E–592, Mar. 23, 1988, vol. 12, No. 89, and JP 62–223940 pub. Oct. 1, 1987.

Copy of German Search Report dated Jun. 22, 1994.

Translation of relevant categories indicated by German Examiner.

*Primary Examiner*—Joseph M. Moy

*Attorney, Agent, or Firm*—Ware, Fressola, Van Der Sluys & Adolphson

[57] ABSTRACT

It is known to provide picture tube parts with identification marks. According to the state of the art, this identification of picture tube parts is achieved by attaching special layers or labels containing the identification data to the outside of the glass pans (10). However, this technique is extraordinarily costly because of the additional layers or labels. The invention shows that the respective identification marks (16) are formed directly on a first functional layer applied to the inside (19) of the respective picture tube part. The process is very simple if the respective identification marks (16) are burned into the first functional layer by means of a laser.

14 Claims, 1 Drawing Sheet

IDENTIFICATION MARKS OF PICTURE TUBE PARTS

This application is a continuation of application Ser. No. 08/302,523 filed on Sep. 8, 1994, now abandoned.

TECHNICAL FIELD

The invention refers to the identification marks of picture tube parts made of glass, which during manufacture undergo heat treatment and a process to identify picture tubeparts.

BACKGROUND OF THE INVENTION

To simplify the manufacturing process, it is known to provide picture tube glass pans with markings, which permit recognition of the glass pan type, or the glass pan itself. The glass pan forms that part of a picture tube, which faces the viewer after it has been installed.

A known way to realize such markings is to place a label on the outside of the respective glass pan. To that effect, according to U.S. Pat. No. 4,374,551, a label with printed information is glued to the glass pan. In view of the temperature processes which the glass pan undergoes during manufacture, it is easy to see that such a solution does not guarantee reliable and permanent marking of picture tube parts. For this reason, DE 38 25 846 also indicates an adhesive label, which has an identification made of glass solder. If this label is glued to the outside of the glass pan, and the pan then undergoes a temperature process, the identification combines with the glass of the pan to form a permanent marking that is no longer removable.

However, if a number of different types of picture tubes are manufactured in a production line, it is considered a disadvantage to use labels, because a corresponding number of labels must be kept on hand for the different types of tubes, and it would be extremely expensive to produce such labels immediately before they are combined with the glass pan. Furthermore, for the latter reason, the variety of information on each label is limited.

According to another state of the art patent (U.S. Pat. No. 4,327,283), the marking of picture tube parts takes place in such a way, that at least one glass frit area is formed on the outside of the respective picture tube part. Depending on the process, the marking is then either made in the form of a machine-readable bar code in that area, and the respective area is then fritted to the glass pan, or vice versa. The formation of the bar code is such, that the application of suitable measures on predetermined areas of the additionally formed area causes the applied glass frit material to be partially removed. The measures that are suitable for removing the glass frit material are indicated as mechanical and chemical processes, including laser technology.

Although this process provides for individual identification of each glass pan, it is considered a disadvantage that this type of marking always requires that at least one layer must be produced on the glass pan in several work steps, which is not required for the picture tube production itself. As pointed out in this regard by U.S. Pat. No. 4,600,630, for reasons of readability, it is necessary to cover the bar code marking produced in U.S. Pat. No. 4,327,283, with a special layer to protect it from contamination.

As was shown in tests performed by the applicant, a direct marking is not realizable, i.e. one that is worked into the surface of the screen glass, because, as also indirectly confirmed by U.S. Pat. No. 4,327,283, it leads to an unacceptable weakening of the glass screen-pan, which is under considerable load in the subsequent installed condition.

For that reason, the invention has the task of introducing markings of picture tube parts, whose manufacture does not require additional layers or materials beyond the production of the respective picture tube part, and which are additionally protected against outside influences.

Another task of the invention is to introduce a process for the production of markings of picture tube parts, which permits to manufacture identification marks of picture tube parts in a very simple process that is safe and protected against outside influences.

SUMMARY OF THE INVENTION

A first task of the present invention is fulfilled in that identification marks of the respective picture tube part are formed on its inside, from an auxiliary arrangement of a first functional layer located directly on the inside of the respective picture tube part, and of areas that are separate from this functional layer. The formation of the identification marks on the inside of glass pans is also of particular advantage, because it does not hinder the subsequent installation of the so-called "implosion-frame" over the outer contour of the glass pan.

If the glass pan is the part of the picture tube that must be marked, the functional layer is either the internal aluminization or the black matrix layer. In this connection it should be pointed out that in black matrix tubes, the layer that is directly on the inside of the glass pan's edge area is the black matrix layer. This black matrix layer is covered by the internal aluminization on the side facing away from the glass of the picture tube part, when the glass pan is being finished. If the internal aluminization is the first functional layer in black matrix tubes, it must be ensured that the pan areas, which contain the identification mark, are no longer covered by the black matrix material, if the internal aluminum layer is installed in a subsequent operation step.

If the picture tube cone is the part being identified, the so-called internal conduction layer is then the first functional layer of this picture tube part. A particularly good contrast of the identification marks is achieved when the free surfaces formed by the first functional layer are covered by another functional layer, which has a high contrast with respect to the material of the first functional layer. If the areas that are free of the first functional layer have been formed in the black matrix layer, a high contrast results if these free areas are covered by the internal aluminization. If the areas which are free of the first functional layer are formed in the picture tube cone, equally good contrast relationships can be achieved when the free areas in the first functional layer (the internal aluminization in this case) are located near the getter. If this narrow spatial relationship is maintained and the getter is later activated, the silvery barium mirror separates from the areas which are free of the internal conduction layer.

A second task of the present invention is fulfilled in that the identification marks are formed on the inside of the respective picture tube part during or after the formation of the first functional layer, where areas, which are not covered by the first functional layer, are formed. These free areas in the first functional layer, or the sequence of free areas and those covered by the first functional layer, form the identification mark/picture of the respective picture tube part.

A particularly good contrast relationship occurs when the areas that are free of the first functional layer are covered by another layer, which is required anyway for the manufacture of the respective picture tube part, and the material of the second functional layer has a high contrast with respect to the material of the first functional layer. For example, if the first functional layer is formed by a black matrix layer, good contrast relationships are achieved if the other functional layer is the internal aluminization.

In principle, the professional decides how the free areas of the first functional layer are formed, insofar as he ensures that no damage or change takes place in the glass or in the glass surface of the respective picture tube part.

However, if the free areas in the first functional layer, which finally form the identification mark, are produced by a laser in this layer, it has the advantage that particularly sharp-edged identification marks are formed. This is especially significant when the identification mark is a bar code.

A particularly simple process is provided when the laser produces the areas, which are free of the first functional layer, through the wall thickness of the respective picture tube part that is made of glass. The latter process is because it is often not possible to locate the laser inside the respective picture tube part, for reasons of space.

If a laser is used to burn the free areas in the first functional layer, whose wave length is about 1.06 μm and which has an output between 15 and 60 watt, there is no danger of the laser causing changes in the glass of the picture tube part, if the distance between laser head and the plane of the first functional layer is about 20 cm.

BEST MODE FOR CARRYING OUT THE INVENTION

The invention will now be explained in more detail by means of the figures.

Figure 1:
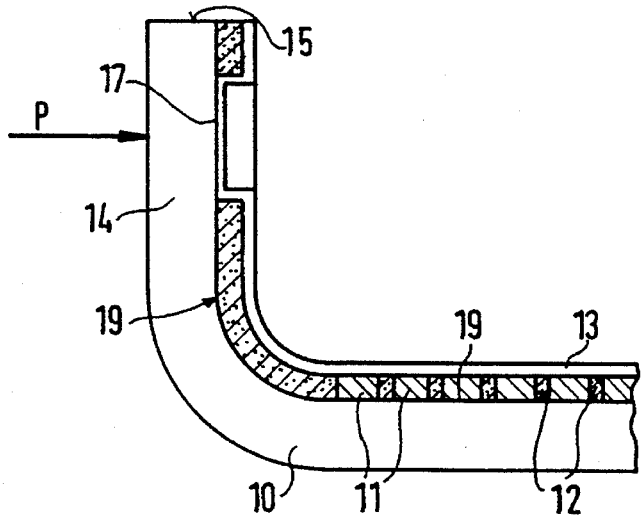
FIG. 1 is a cut through the glass pan of a picture tube.

FIG. 1 illustrates a cut through a picture tube part in the form of a glass pan 10. On the side facing away from the viewer, this glass pan 10 is covered by luminescent material strips 11, which emit light under the effect of electron beams (not illustrated). To improve the contrast, the distance between each two neighboring luminescent material strips 11 is filled with a light absorbing material 12. This type of shielding of the inside of glass pans 10 is usually also called the black matrix structure. The so-called internal aluminization 13 is formed over the layer of luminescent material strips 11 and light absorbing material 12. The internal aluminization 13 is a layer of metal, preferably aluminum, which is formed on the inside of the glass pan by means of an evaporation process.

It should be pointed out for the sake of completeness, that before the internal aluminization 13 is deposited, the surface to be coated by evaporation is prepared by using at least one enamel coating step. This enamel coating is not illustrated in FIG. 1 for reasons of clarity, but can be recognized in the production stage between the internal aluminization 13 and the layer consisting of luminescent material strips 11 and light absorbing material 12.

Figure 2A:
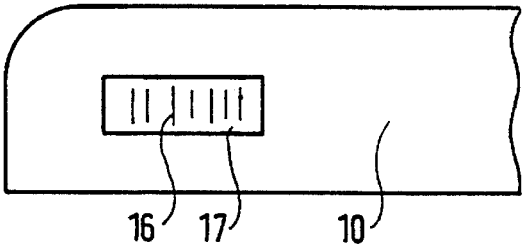
FIGS. 2*a* and 2*b* are side views of the glass pan of a picture tube.

A deep-drawn edge 14 adjoins the area of the glass pan 10 that is provided with luminescent material strips 11 and the light absorbing material 12. The surface 15 of this edge 14 is later connected to the picture tube cone (not illustrated). The coating sequence on the inside 19 of the glass pan 10 in the edge area 14 is very similar to the one already explained in connection with the inside that faces away from the viewer. However, these explanations differ in that the luminescent material 11 is no longer present in the edge area 14, rather the light absorbing material 12 covers nearly the entire inside 19 of the glass pan 10. The only exception from the inside 19 of the edge area 14 coated with light absorbing material 12 is the surface 17, on which the identification marks will later be produced. As can clearly be seen in FIG. 1, the internal aluminization 13 is placed directly on the glass surface of glass pan 10 in the area of surface 17, and forms the first functional layer in the depicted configuration example. As shown in more detail in FIG. 2*a*, the identification marks 16, which are produced in accordance with the individual specifications of the manufacturer, can be formed on surface 17 by removing the internal aluminization 13 down to the glass surface of glass pan 10.

In principle, it is immaterial which measures the professional uses to remove the internal aluminization 13 to form the identification marks 16, insofar as such procedures do not change the glass structure itself. For example, the scratching off of the internal aluminization 13 should only be mentioned as a mechanical process in this area. However, if particularly sharp-edged identification marks 16 are to be produced, such as are necessary to ensure that bar codes are machine-readable (shown in FIG. 2*a*), it is especially advantageous to produce such identification marks 16 with a laser. Which measures must be observed with the use of a laser, will be discussed in greater detail later on.

In addition, it should be pointed out that the identification marks 16 can also be formed in the internal aluminization 13, in that the areas that are ultimately free of the internal aluminization 13, and the areas containing the identification marks 16, can be produced simultaneously with the application of the internal aluminization 13, by means of suitable masking measures.

Figure 2B:
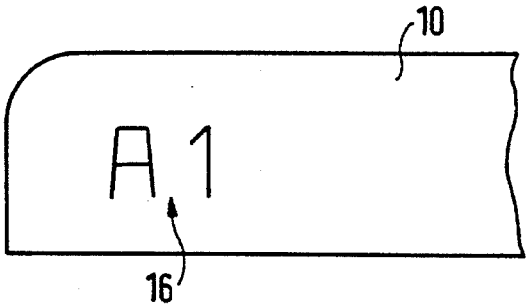

FIG. 2*b* clearly depicts an identification mark 16. In contrast to the illustrations in FIGS. 1 and 2*a*, no layer of light absorbing material 12 is formed on the inside of the glass pan 10. For that reason glass pans 10 produced in this way do not require an area 17 that is free of light absorbing material 12 on the inside of the edge area 14 of glass pan 10, because the internal aluminization 13 is directly deposited on the surface of the glass pan 10 in the edge area 14, after the evaporation of aluminum, for example. According to the configuration example in FIG. 2*b*, the respective identification marks 16 can be formed during or after application of the internal aluminization 13 on the inside 19 of the edge area 14. The latter process is also possible with the black matrix structures, explained in connection with FIGS. 1 and 2*a*, if it is ensured that the entire inside surface of the edge area 14 is not covered by this material 12 when the layer of light absorbing material 12 is applied.

Nor is the glass pan in FIG. 2*b* limited to the formation of the identification marks 16 shown in the clear text depiction (FIG. 2*b*). Rather, in the instances where the entire inside surface of the edge area 14 is coated with the internal aluminization 13, the identification marks 16 can be produced in bar code form, as shown in connection with FIG. 2*a*.

As already indicated earlier, it is especially advantageous to produce the respective identification marks 16 with a laser. Since glass pans 10 in picture tubes are extraordinarily loaded components in the mounted condition, the use of laser technology must ensure that the structure of the glass pan 10 is not subjected to changes during the burn-in of the identification marks 16. This is relatively easy to achieve, if the laser beam impacts the internal aluminization 13 from the inside of the glass pan 10. Such a process is only conditionally possible, because of the narrow space relationships inside the pan 10. For that reason, if the formation of the identification marks 16 is performed from the outside, through the thickness of the glass, to the internal aluminization (depicted by arrows P in FIGS. 1 and 3), special conditions must be provided, which avoid heat loading the gas in the burn-in area. This is particularly difficult with respect to the types of glass used to manufacture glass pans 10, because these glass pans are not transparent, and the glass in addition contains admixtures e.g. of Br, Ca, Li and Sr. Furthermore, focusing the laser through the glass thickness is not uncritical, because the inside of the glass pan 10 has a defined roughness for better adhesion of the layers on the inside of the glass pan 10.

Figure 3:
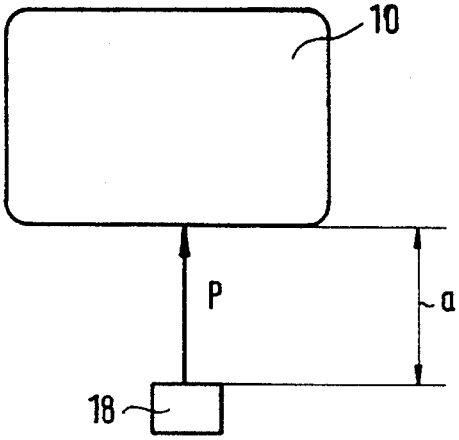
FIG. 3 is a (schematic) device for producing identification marks.

However, these problems are solved if a writing laser with a wavelength of 1.06 μm and an output between 15 and 60 watts is used, and the distance between the laser head 18 and the plane of the internal aluminization 13, on which the writing takes place, is about 20 cm (FIG. 3). Laser devices conforming to these performance data are available in the market and may be acquired, for example, from the manufacturer Haas-Laser GmbH, Schramberg, under the name of Hass 6211. If the identification marks 16 are produced with laser technology, identification marks 16 produced in this manner can contain a high degree of information, without the application of the identification hindering the production.

In addition, it should be pointed out that the burn-in of identification marks 16 by means of a laser device is not necessarily a one-step operation. Rather, in the production of bar code identification marks 16 (FIG. 2*a*), to increase readability by machine, it is very advantageous to form such identification marks in two steps, where in the first step the areas where the identification marks will be located are cleaned flat by the laser, and then in a second step, the contour of the areas, which were removed during the first step, are reworked with the laser device to increase the sharpness of the edges.

In the configuration example explained in conjunction with FIG. 1, after the glass pan 10 has been coated with the light absorbing material 12, the latter is removed from the area 17, or it was already kept free of material 12 by the use of suitable masking measures. However, this measure is no longer required with the use of the above described laser technology, for example. If the raised edge of the glass pan 10 is fully coated with light absorbing material 12, and the glass pan 10 is fully covered with luminescent material 11, the identification marks 16 can be directly burned into the light absorbing layer 12 on the edge area of the glass pan 10, by means of a suitable laser. In that case, the coating 12 forms the first functional layer of the glass pan 10. If the entire glass pan 10 is provided with the internal aluminization 13 after the burn-in of the identification marks 16, in the area where the identification marks 16 were burned into the layer 12, the aluminum of the internal aluminization 13 is directly deposited on the glass surface in the areas that were burned clean on the inside 19 of the glass pan 10. Since these identification marks 16 were formed by a sequence of light absorbing material 12 and internal aluminization 13, the resulting good contrast extends very good readability to the identification marks 16.

It is further pointed out that picture tube cones (not illustrated) can be very easily identified. This can be achieved in that the identification marks 16 are formed in the so-called internal conducting layer (=first functional layer of the cone) during or after the application and drying of the internal conducting layer, by producing areas that are free of the internal conducting layer for application of the identification marks 16. In this instance as well, the identification marks 16 can be burned into the internal conducting layer of the cone by a laser. Since the location of clean and not clean areas in the brownish red internal conducting layer is difficult to recognize from the outside, the readability of the coding in the picture tube cone is achieved by coating the areas in the internal conducting layer that were burned clean, with a silvery barium mirror for example, which is used anyway in the production of the picture tube, and by activating the getter of the completed picture tube to burn off any residual gases in the vacuum. However, since the barium mirror is only deposited in a narrow space around the getter, and in order to produce good contrast relationships, it is necessary for the burn-in areas of the identification marks 16 in the internal conducting layer to be located near the getter.

We claim:

1. A picture tube part made of glass, having an identification mark and having an inside surface with at least one layer of material applied thereto that is used during the operation of the picture tube part, wherein the identification mark (16) is formed on the inside surface (19) by removing a part of said at least one layer of material.

2. A picture tube part as in claim 1, wherein the at least one layer of material is either an internal aluminization (13) or a black matrix coating (12) of a glass pan (10), or an internal conducting layer of a picture tube cone.

3. A picture tube part as in claim 2, wherein areas that are free of the at least one layer of material (12, 13) are coated with a second layer of material which is necessary for the manufacture of the picture tube part.

4. A picture tube part as in claim 2, wherein the second layer of material is the internal aluminization (13) of the glass pan (10) for a black matrix structure, or is for the formation of the identification mark (16) on the internal conducting layer of the picture tube cone, which is a barium mirror that is created when a getter is activated.

5. A picture tube part as in claim 1, wherein areas that are free of the at least one layer of material (12, 13) are coated with a second layer of material which is necessary for the manufacture of the picture tube part.

6. A glass pan for a picture tube, comprising:

at least one picture tube display layer of material applied to an inside surface of the glass pan for emitting light under the effect of electron beams; and an identification mark formed on the inside surface of the glass pan by removing a part of the layer of picture tube display material.

7. A glass pan for a picture tube according to claim 6, wherein said at least one picture tube display layer includes a layer of internal aluminization having a part thereof applied directly on the inside surface of the glass pan in a first identification mark surface.

8. A glass pan for a picture tube according to claim 6, wherein said at least one picture tube display layer includes a layer of internal aluminization applied directly on the inside surface of the glass pan in a first identification mark surface, except for a part of the first identification mark surface having a mask containing information of the identification mark.

9. A glass pan for a picture tube according to claim 6, wherein said at least one picture tube display layer includes a layer of internal aluminization applied directly on an edge area of the inside surface of the glass pan, and the identification mark is formed either during the application of the layer of internal aluminization on the edge area by using a mask containing information of the identification mark, or after the application of the layer of internal aluminization on the edge area by removing a part of the layer of internal aluminization on the edge area.

10. A glass pan for a picture tube according to claim 6, wherein the at least one picture tube display layer includes a first layer of black matrix coating applied directly on one part of the inside surface, a second layer of luminescent material applied on another part of the inside surface, and a third layer of internal aluminization covering the first and second layer.

11. A glass pan for a picture tube according to claim 6, wherein the identification mark is formed on the inside surface of the glass pan by removing a part of the layer of picture tube display material with a laser.

12. A glass pan for a picture tube according to claim 6, wherein the identification mark is formed on the inside surface of the glass pan with a laser (18).

13. A glass pan for a picture tube according to claim 6, wherein the at least one layer includes a black matrix coating applied directly on one part of the inside surface, a luminescent material applied on another part of the inside surface, and a layer of internal aluminization formed over the black matrix coating and the luminescent material.

14. A glass pan for a picture tube according to claim 6, wherein the at least one picture tube display layer includes a layer of internal aluminization.

* * * * *